United States Patent [19]

Geppelt et al.

[11] Patent Number: 5,002,119

[45] Date of Patent: Mar. 26, 1991

[54] HEADER AND TUBE FOR USE IN A HEAT EXCHANGER

[75] Inventors: Elmo W. Geppelt; William H. Poore, both of Tulsa, Okla.; Richard D. Christensen, Columbus, Ohio

[73] Assignee: G.P. Industries, Inc., Tulsa, Okla.

[21] Appl. No.: 503,295

[22] Filed: Apr. 2, 1990

[51] Int. Cl.[5] ..... F28F 9/04

[52] U.S. Cl. ..... 165/79; 165/173; 165/905

[58] Field of Search ..... 165/79, 173, 905

[56] References Cited

U.S. PATENT DOCUMENTS

| | | | |
|---|---|---|---|
| 4,295,522 | 10/1981 | Frei | 165/79 |
| 4,529,034 | 7/1985 | Saperstein | 165/134.1 |
| 4,576,223 | 3/1986 | Humpolik et al. | 165/79 |
| 4,858,686 | 8/1989 | Calleson | 165/173 |

FOREIGN PATENT DOCUMENTS

| | | | |
|---|---|---|---|
| 295274 | 11/1916 | Fed. Rep. of Germany | 165/79 |
| 2602582 | 2/1988 | France | 165/79 |
| 198851 | 6/1923 | United Kingdom | 165/79 |
| 421062 | 12/1934 | United Kingdom | 165/79 |

*Primary Examiner*—Allen J. Flanigan
*Attorney, Agent, or Firm*—Head & Johnson

[57] ABSTRACT

A header and tube assembly for use in a shell-and-tube type heat exchanger formed of a header plate having a plurality of spaced apart openings therethrough, each opening having a large cross-sectional area in the portion adjacent the header outer surface than the cross-sectional area adjacent the inner surface, a tube received in each of the openings, each tube having an outer end extending at least even with the header outer surface, and a sealer filling each of the openings in the header and surrounding the tube in the openings to thereby secure each tube in a leak-proof arrangement. In one embodiment, each opening in the header is of conical cross-sectional configuration, and in another embodiment, each opening in the header has a smaller cross-sectional portion adjacent the header inner surface dimensioned to snugly receive the tube and a larger cross-sectional portion adjacent the header outer surface to receive the sealer therein.

6 Claims, 2 Drawing Sheets

HEADER AND TUBE FOR USE IN A HEAT EXCHANGER

SUMMARY OF THE INVENTION

A common type of heat exchanger is called a "shell-and-tube". In this type of heat exchanger a liquid containing vessel, referred to as a shell, has an inlet and an outlet opening. Within the shell is positioned a bundle of tubes. Each end of each tube is connected to a header, the header being sealed in the wall of the shell, and the header providing a means by which fluid can flow through the tubes. In this manner one fluid flow path is through the tubes, and the other fluid flow path is through the interior of the shell. Heat is transferred through the walls of the tubes between the fluid flowing within the tubes and the fluid flowing within the shell. Since heat transfer is directly related to the cross-sectional area separating the two fluids, the use of a large number of smaller diameter tubes is preferable to the use of a small number of larger diameter tubes, that is, the cross-sectional area per unit volume is greater when small diameter tubes are employed. For this reason shell-and-tube heat exchangers usually employ a larger number of small diameter tubes. Some means must be provided to afford communication to fluid flow through the plurality of small diameter tubes and, at the same time, to seal the small diameter tubes with respect to the shell. Therefore, the most common means of practicing the shell-and-tube type heat exchanger is to support the ends of the tubes in headers.

In the usual arrangement, there are two headers, an inlet header and an outlet header, that is, an inlet header which assembles in close proximity and paralleled arrangement all of the inlet ends of the tubes, and an outlet header which assembles in close proximity all of the outlet ends of the tubes. Such tube/header assemblies have long been used in many types of heat exchanges. In some types of heat exchangers wherein high temperatures or high pressures are employed, a common means of securing the tubes to the headers is by welding each end of each tube to its header. In other types of arrangements wherein lower fluid pressures are employed, the tubes, when formed of metal, can be roll-expanded at each end to compressibly engage the header in which they are received. In still a different type of tube/header arrangement, the opening in which each tube is received is enlarged and externally threaded, and a threaded member is received in the opening, compressing a gasket against the exterior of the tube. These different systems are merely exemplary of types of tube/-header assemblies which have been employed in shell-and-tube heat exchangers.

Regardless of the means of interconnecting the tubes with the headers, the process of forming a tube/header assembly is a time consuming and, therefore, expensive arrangement. The basic object of the present disclosure is to provide a simplified and improved means for forming a tube/header assembly, and, therefore, a method which substantially improves the economy of construction of a shell-and-tube heat exchanger. At the same time, the disclosure provides a tube/header assembly for use in a shell-and-tube heat exchanger in which the tubes are affixed to the headers in a way to decrease the likelihood of leakage occurring around the tubes where they join the header.

In the present disclosure of a tube/header assembly, a header plate is employed having an outer surface and an inner surface. A plurality of spaced apart openings are formed in the header. Each opening has a larger cross-sectional area in the portion thereof adjacent the outer surface than the cross-sectional area adjacent the header inner surface.

A tube is received in each of the openings in the header. Each tube has an end extending at least even with the header outer surface. The cross-sectional area of each opening in the header adjacent the header inner surface is dimensioned to snugly receive the tube therein. That is, the diameter of the opening in the area thereof adjacent the header inner surface is only slightly larger than the external diameter of the tube received therein, so as to permit sliding placement of the tube in the header with a snug fit.

A sealant, applied in liquid or paste form, is used to fill each opening in the header around each of the tubes received therein. The sealant may be a variety of adhesive materials, including naturally occurring adhesives, elastomers, plastics or polymers, in which the sealant material flows as a liquid for injection within each opening around the tube therein and, after injection, solidifies to provide a bond between the header and each of the tubes received in the header. The sealant selected must be compatible with the contacting fluids, and must permit the expansion and/or contraction which will occur in the heat exchanger. The sealant selected must have the characteristics so that, upon solidification, a temperature tolerant and pressure resistant seal is achieved. In one embodiment, a sealant may be selected which, upon solidification, is semi-rigid to thereby provide a degree of flexibility so that any slight movement of a tube relative to a header will not crack the filling material. In this way a shock proof tube/header assembly is achieved.

In one embodiment, the tubes may be generally straight and adjacent each other in rows, columns, or other geometrical patterns with a header at each end of the tubes. The headers are therefore spaced apart and parallel to each other. In another embodiment, the headers may be elongated and arranged generally in a common plane and spaced apart from each other. These different embodiments are utilized to illustrate that the specific configuration of the tube/header assembly can vary considerably and is entirely dependent upon the application to which the heat exchanger is to be placed and the physical dimensions required of the heat exchanger.

A better understanding of the invention will be had by reference to the following description and claims, taken in conjunction with the attached drawings.

DESCRIPTION OF THE PREFERRED EMBODIMENTS

Figure 1:
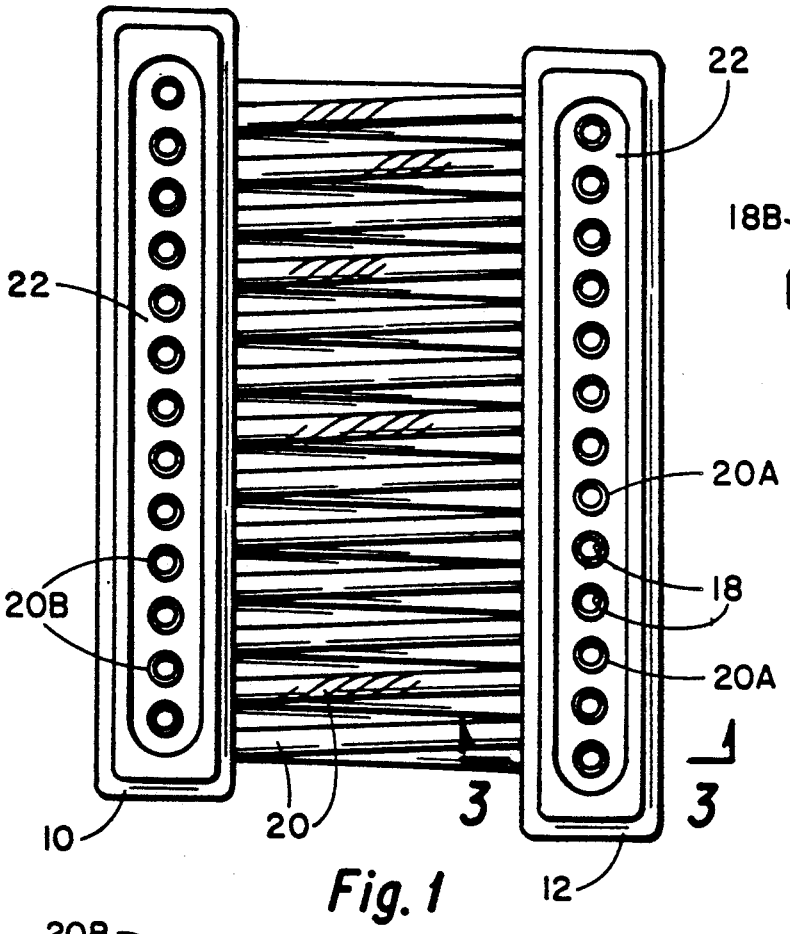
FIG. 1 is a top view of a tube/header assembly for use in a shell-and-tube type heat exchanger in which the headers are elongated, spaced apart from and are parallel to each other, with the headers being generally in a common plane.
Figure 3:
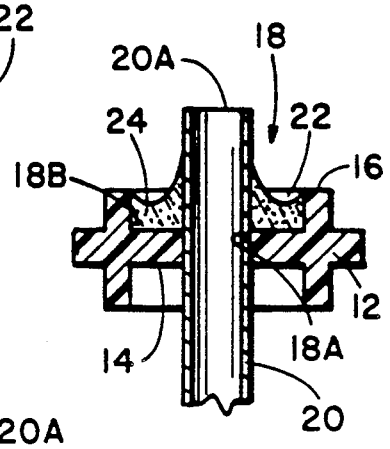
FIG. 3 is an enlarged partial cross-sectional view taken along the line 3—3 of FIG. 1, showing one cross-sectional configuration of the headers of FIG. 1 and showing the means of retaining the end portion of each tube within a header.
Figure 2:
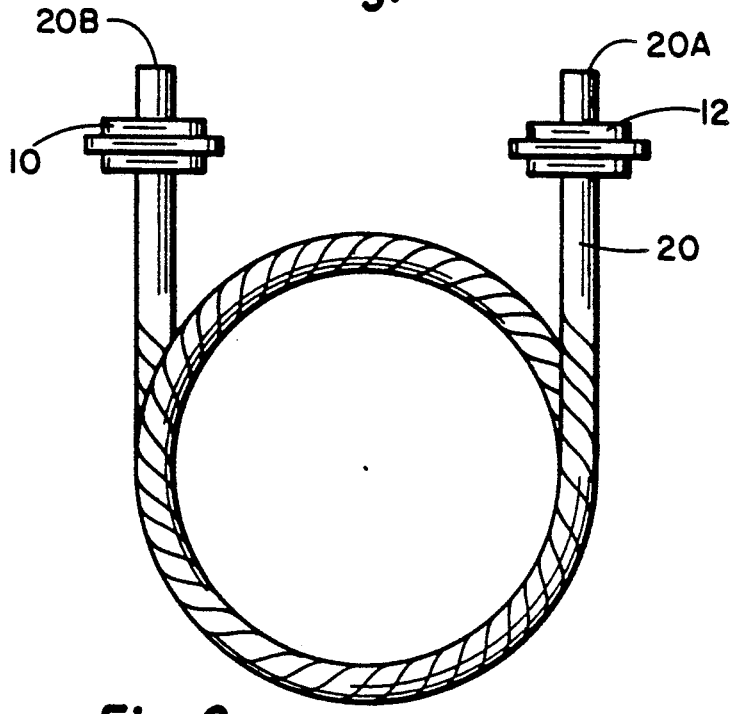
FIG. 2 is an end view of the tube/header assembly of FIG. 2.

Referring first to FIGS. 1 and 2, a type of tube/-header assembly for use in a shell-and-tube heat exchanger is disclosed. This arrangement includes a first header 10 and a second header 12, the header being spaced apart and parallel to each other and in a common plane. Each header has an inner surface 14 and an outer surface 16, as best shown in FIG. 3. Formed in header 12 are plurality of openings 18. Received in each opening 18 is the end portion of a tube 20. In the arrangement of the tube/header assembly of FIGS. 1 and 2, each of the tubes 20 is formed as a coil or loop, that is, each tube turns approximately 540 degrees (1½ turns) so that, as shown in FIG. 2, one end 20A extends through header 12 and the other end 20B through header 10. FIGS. 1 and 2 are exemplary of one form of a tube/-header assembly for use in a shell-and-tube type heat exchanger.

The assemblies of FIGS. 1 and 2 are used in a vessel (not shown) which forms the shell of the heat exchanger, the vessel having openings for receiving headers 10 and 12 for securing the headers to the vessel in leak-proof arrangement. The vessel has inlet and outlet openings (not shown) through which fluid flows so as to flow fully around the external surfaces of each of the tubes 20.

Each of the headers 10 and 12 provide a means of flowing fluid through the tubes. For instance, header 10 may function as an inlet header, that is, fluid flows to a portion of the header (not shown) that communicates with each tube end 20B, and, in a like arrangement, a header communication portion (not shown) for the outlet header 12 receives fluid flow from each of the tube outlet ends 20A.

The tube/header assembly described to this point is not unlike other similar assemblies used for manufacturing shell-and-tube heat exchangers. Of importance in the manufacture of tube/header assemblies is the interconnection between headers 10 and 12 and tubes 20. FIG. 3 shows the way this is accomplished in the present disclosure. The opening 18 in header 12 has an inner, small diameter portion 18A and an outer, larger diameter portion 18B. The portion 18A is adjacent the header inner surface 14, while the enlarged diameter portion 18B is adjacent the header outer surface 16. The enlarged diameter portion 18B of the opening provides a reservoir area 22 around each of the tubes 20. This reservoir area is filled or at least partially filled with liquid sealant 24, which can be a natural occurring adhesive, an elastomer, a plastic or a polymer. The sealant is applied as a liquid and solidifies into a rigid or semi-rigid solid, bonding the tube 20 to header 14. In the same manner, the portions of the tube adjacent the inlet ends 20B are secured to header 10. In the arrangement of FIGS. 1, 2 and 3, the enlarged diameter portions 18B of each opening 18 is in communication with the adjacent enlarged diameter openings, so that the reservoir area 22 extends substantially the full length of each of the headers. In the embodiment of FIGS. 1 and 2 this reservoir area 22 is filled or substantially filled with liquid sealant 24, which, when solidified, bonds the tubes to the headers.

Figures 4, 5, 6, 7:
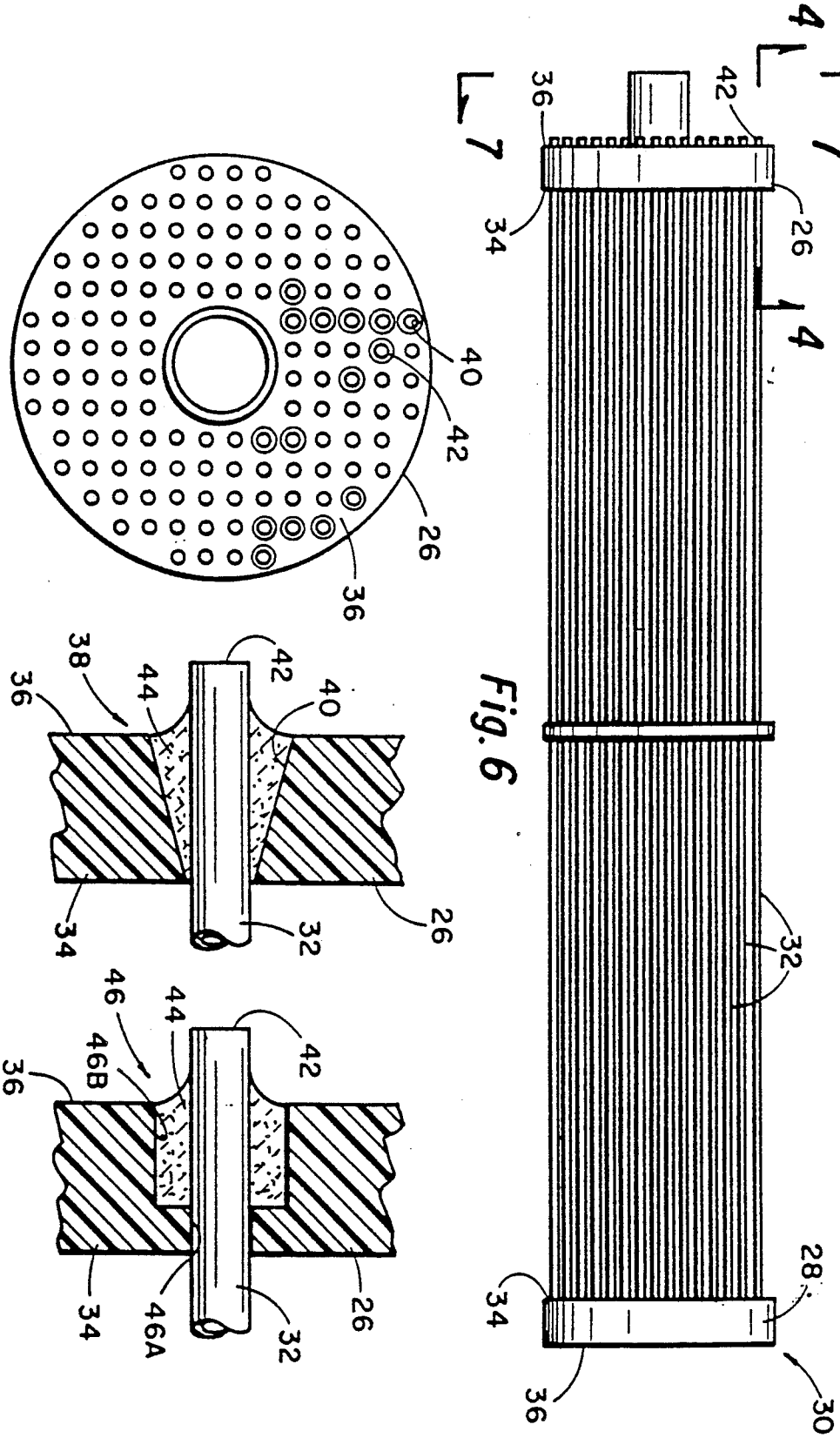
FIG. 4 is an enlarged cross-sectional view as in FIG. 3 showing portions of a header and showing a tube received therein, and with the opening in the header being frustro-conical shape and showing the use of a sealer for securing the tube within the header.
FIG. 5 is an alternate cross-sectional view as in FIGS. 3 and 4, showing another configuration of each hole formed in the header with the tube received therein and showing the use of a sealer for securing the tube to the header.
FIG. 6 is an elevational view of a different type of tube/header assembly as used in a shell-and-tube heat exchanger wherein the headers are spaced apart from each other, paralleled to each other, and are interconnected by generally straight tubes packaged parallel and adjacent each other in a cylindrical geometrical arrangement.
FIG. 7 is an end view of the tube/header assembly of FIG. 6.

FIGS. 6 and 7 show a different geometrical arrangement of a tube/header assembly in which the headers 26 and 28 are spaced apart and in planes parallel to each other. The entire assembly, indicated generally by the numeral 30 in FIG. 6, is a cylindrical package formed of a plurality of straight tubes 32 positioned adjacent and paralleled to each other. Space is provided between the tubes 32 so as to allow fluid within the shell (not shown) to flow to accomplish heat exchange with fluid flowing through the tubes.

Headers 26 and 28 are generally planar cylindrical members and each has an inner surface 34 and an outer surface 36. (See FIGS. 4 and 5). Formed in each of the headers are a plurality of openings, there being one opening for each tube 32. FIG. 4 is a cross-sectional view as taken along the line 4—4 of FIG. 6 and shows header 26 with an opening, generally indicated by the numeral 38, therein. The opening 38 of FIG. 4 is frustro-conical in configuration, having a tapered frustro-conical wall 40. Opening 38 provides a small diameter opening at the header inner surface 34 and a large diameter opening at the outer surface 36. The diameter of the opening 38 at the header inner surface 34 is preferably slightly larger than the diameter of tube 32 so as to snugly receive the tube, while the opening adjacent the outer surface 36 is substantially larger than the tube.

Tube 32 extends through opening 38 so that the tube end 42 is even with or slightly beyond the plane of header outer surface 36. The space between the exterior of tube 32 and wall 40 is filled with sealant 44 in the same way that sealant 24 is applied in the embodiments of 1, 2 and 3. Sealant 44 is applied as liquid and solidifies into a rigid or semi-rigid solid to bond tube 32 to header 36.

FIG. 5 shows an alternate arrangement wherein a different shaped hole, generally indicated by the numeral 46, is employed in header 26. Hole 46 is formed of two different diameters, that is, a small diameter portion 46A and a large diameter portion 46B. The small diameter portion 46A is adjacent the header inner surface 34, while the large diameter portion 46B is adjacent the header outer surface 36.

The hole small diameter portion 46A is dimensioned to be just slightly larger than the external diameter of tube 32 to snugly receive the tube, whereas the large diameter portion 46B is dimensioned to be substantially larger than the diameter of tube 32. This larger diameter portion 46B is filled with sealant 44 in the same manner as described with reference to FIG. 4. The sealant is injected in liquid form and solidifies into a rigid or semi-rigid solid.

The principles of this disclosure are particularly applicable to heat exchangers wherein heat is to be exchanged between two fluids, neither of which are subjected to extreme pressures or temperatures. For this reason headers 10 and 12 of FIGS. 1 and 2, and headers 26 and 28 of FIGS. 6 and 7 may be of plastic material. Tubes 20 are preferably of metal, since metal has a much higher heat transfer rate. Tubes 20 may be made of aluminum, steel, copper or the like, aluminum being preferred when economy is desired. Heat exchangers for use in maintaining the desired temperature of blood circulated in a patient during open heart and other types of major surgeries can effectively and economically be manufactured utilizing the tube/header assemblies of the type shown in FIGS. 1 and 2 or in FIGS. 6 and 7. It is understood, as previously indicated, that the specific geometric arrangement of the tube/heater assemblies manufactured according to the principles of this disclosure may vary considerably, and such arrangements are dictated by the configuration of the shell in which the tube/header assemblies are employed which, in turn, is dictated by the particular application of the heat exchanger. The actual appearance of tube/header assemblies practicing this disclosure may be completely different from those illustrated.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplication, but is to be limited only by the scope of the attached claim or claims, including the full range of equivalency to which each element thereof is entitled.

What is claimed is:

1. For use in a shell and tube type of heat exchanger a header and tube assembly comprising:

a header plate having an outer surface and an inner surface and having a plurality of spaced apart openings therethrough, each opening having a larger cross-sectional area in the portion thereof adjacent the outer surface than the cross-sectional area adjacent the inner surface, each of said openings in said header plate being formed of a small diameter cylindrical portion adjacent said header plate inner surface and the opening being further formed by an enlarged diameter cylindrical portion adjacent said header plate outer surface;

a tube received in each of said openings in said header, each tube having an end extending at least even with said header outer surface, the cross-sectional area of said smaller diameter cylindrical portion of each said opening in said header adjacent said header inner surface being dimension to snugly receive the tube received therein; and a sealer at least substantially filling said enlarged diameter cylindrical portion of each said openings in said header and surrounding said tube in said opening, said tubes being thereby secured to said header in leak-proof arrangement.

2. A header and tube assembly according to claim 1 wherein said sealer is selected from a group comprising naturally occurring adhesives, elastomers, plastics and polymers.

3. A header and tube assembly according to claim 1 wherein said header plate is a circular, flat member adaptable for being received in a cylindrical shell.

4. A header and tube assembly according to claim 1 wherein said header plate is a generally rectangular planar member.

5. For use in a shell and tube type of heat exchanger a header and tube assembly comprising:

a header plate having an outer surface and an inner surface and having a plurality of spaced apart openings therethrough, the header plate outer surface being defined by an increased thickness portion surrounding said openings;

a tube received in each of said openings in said header, each tube having an end extending at least even with said header outer surface increased thickness portion, the cross-sectional area of at least a portion of each said opening in said header being dimension to snugly receive the tube received therein; and a sealer at least substantially filling said area of said header outer surface surrounding said openings defined by said increased thickness portion and surrounding said tube in said opening, said tubes being thereby secured to said header in leak-proof arrangement.

6. A header and tube assembly according to claim 5 wherein said sealer is selected from a group comprising naturally occurring adhesives, elastomers, plastics and polymers.

* * * * *